US007240860B2

(12) United States Patent
Griend

(10) Patent No.: US 7,240,860 B2
(45) Date of Patent: Jul. 10, 2007

(54) WATER DISTRIBUTION PLATE FOR ROTATING SPRINKLERS

(75) Inventor: Loren Vander Griend, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 796 days.

(21) Appl. No.: 10/640,283

(22) Filed: Aug. 14, 2003

(65) Prior Publication Data

US 2004/0124261 A1 Jul. 1, 2004

Related U.S. Application Data

(62) Division of application No. 09/982,084, filed on Oct. 19, 2001, now Pat. No. 6,688,539.

(51) Int. Cl.

| | |
|---|---|
| ***B05B 1/00*** | (2006.01) |
| ***B05B 1/26*** | (2006.01) |
| ***B05B 1/34*** | (2006.01) |
| ***B05B 15/00*** | (2006.01) |

(52) U.S. Cl. ..... 239/596; 239/461; 239/463; 239/483; 239/542; 239/381

(58) Field of Classification Search ..... 239/596, 239/461, 463, 483, 501, 542, 381, 382, 383, 239/237, 241

See application file for complete search history.

(56) References Cited

U.S. PATENT DOCUMENTS

| | | | | |
|---|---|---|---|---|
| 458,607 A | | 9/1891 | Weiss | |
| 4,356,972 A | | 11/1982 | Vikre | |
| 4,796,811 A | | 1/1989 | Davisson | |
| D312,865 S | | 12/1990 | Davisson | |
| 4,986,474 A | | 1/1991 | Schisler et al. | |
| 5,058,806 A | | 10/1991 | Rupar | |
| 5,224,653 A | * | 7/1993 | Nelson et al. | 239/222.17 |
| 5,288,022 A | | 2/1994 | Sesser | |
| 5,439,174 A | * | 8/1995 | Sweet | 239/222.17 |
| 5,671,886 A | * | 9/1997 | Sesser | 239/222.21 |
| 6,244,521 B1 | * | 6/2001 | Sesser | 239/222.17 |
| 6,341,733 B1 | * | 1/2002 | Sweet | 239/222.17 |

* cited by examiner

*Primary Examiner*—Davis Hwu
(74) *Attorney, Agent, or Firm*—Nixon & Vanderhye, PC

(57) ABSTRACT

A rotor plate for a sprinkler includes a water impingement surface bounded by an annular peripheral wall and having a radial center, and adapted to be impinged upon by a stream emitted from a nozzle. The water impingement surface is formed to include at least one radially extending drive channel having an entrance proximate the radial center and an exit in the peripheral wall, the drive channel curving from entrance to exit in a first direction so as to cause the plate to rotate when the stream exits at an offset from the center of rotation; at least one range channel extending substantially radially with little or no curving, from entrance to exit; and at least one brake channel curving from entrance to exit in a second direction opposite the first direction to thereby resist rotation of the plate caused by at least one drive channel.

16 Claims, 4 Drawing Sheets

WATER DISTRIBUTION PLATE FOR ROTATING SPRINKLERS

This application is a division of application Ser. No. 09/982,084, filed Oct. 19, 2001 now U.S. Pat. No. 6,688, 539, the entire content of which is hereby incorporated by reference in this application.

BACKGROUND OF THE INVENTION

This invention relates tp water distribution for irrigation purposes and, more particularly, to a water distribution plate for a rotatable sprinkler head.

Sprinkler heads of the type disclosed in U.S. Pat. No. 4,660,766 include a sprinkler body or housing having an inlet which is adapted to be connected to a source of water under pressure. The outlet is defined by a nozzle that directs the water under pressure communicating with the sprinkler body as a primary stream into the atmosphere along a generally vertically extending axis. A rotary water distribution plate (also referred to as a "rotor plate") is provided for receiving the primary stream and directing it outwardly in a circular distribution pattern. A viscous damper mechanism is provided for reducing the rotational speed of the distribution plate from a relatively high whirling speed that would occur without the viscous damper, to a relatively slow speed.

One advantage of this type of sprinkler is that by limiting the rotational speed of the rotor plate, the water contacting the rotor plate can be projected outwardly so that stream integrity is maintained beyond the plate. Thus, the water distribution pattern can be made to closely simulate the highly desirable water distribution pattern of an impact sprinkler head.

Rotor plates are known that simply redirect the vertical stream to a substantially horizontal stream, or that first divide the primary stream into two or more streams through the use of grooves or channels radiating from the center of the rotor plate.

Rotation of the rotor plate is achieved by curving the one or more water distribution grooves or channels toward the exit ends of the grooves or channels, or by offsetting the grooves or channels from the center of rotation of the plate. Thus, water exiting the grooves causes the plate to rotate in a well understood manner. An example of a multi-channel rotor plate configuration is shown in commonly owned U.S. Pat. No. 4,796,811.

A disadvantage of the prior designs is that the radial distribution pattern has a smaller throw radius than if the grooves were straight and on center. Another disadvantage is the difficulty in maintaining a generally consistent rotation speed over a flowrate and pressure range. It is also a continuing objective to achieve good uniformity of the wetted area for all nozzle sizes, and at the same time, to increase the radius of throw so that the number of sprinklers required for a given area can be reduced.

BRIEF SUMMARY OF THE INVENTION

In one exemplary embodiment of the present invention, a water distribution plate, or rotor plate, includes a surface incorporating individual pairs of channels that are shaped to perform different functions. A first pair of channels (referred to as "drive channels") causes the plate to rotate when impinged by a stream emitted from a nozzle. A second pair of channels (referred to as "brake channels") tends to slow rotation of the plate, while a third set of channels (referred to as "range channels") is substantially neutral with respect to plate rotation but increases the range or throw radius of the stream. Two additional but larger channels (referred to as "fill channels") serve primarily to fill in the pattern between the sprinkler and the maximum stream throw radius. By separating the functions of drive, range, and braking in various channels, it is possible to enhance desirable performance parameters including radius of throw, distribution pattern, and consistency of rotation speeds.

The plate itself is a disk-like member, one end of which is provided with a blind bore or the like to facilitate attachment of the plate to, for example, the damping device of a viscous damped sprinkler. The opposite end is formed with the above mentioned channels, with each channel extending generally from the center of the plate, radially outwardly to an exit location along the side wall of the plate. It will be appreciated that the grooves or channels transition from a sharply angled orientation (i.e., at an acute angle relative to the axis of the rotation that is substantially coincident with the stream emitted from the nozzle) at the plate center to a generally horizontal orientation at the plate periphery to thereby radially distribute the stream.

In one embodiment, a first group of drive, range and brake channels are located substantially diametrically opposite a second group or set of similar (mirror image) channels, with a pair of fill channels separating the two groups. The drive channels each comprise a substantially flat bottomed channel with steeply sloped sides. The drive channels curve from entrance to exit, so that the water exit is offset from the radial center, thus causing the disk to rotate in a direction opposite the direction of curvature as water flows through the channels. Note that the two drive channels on opposite sides are curved in opposite directions so that the offsets of both contribute to the drive function.

The range channels lie between adjacent drive and brake channels, and are also generally diametrically opposite each other. Each range channel has a substantially V-shaped cross-section at its radially innermost or entrance point, quickly transitioning to a substantially U-shaped cross-section for substantially its entire length, with upwardly curved side walls tapering outwardly from the center for only a short radial distance, and then exhibiting a substantially constant width to the exit location in the peripheral wall. These channels provide tight streams with maximum radius of throw and good wind fighting capability.

The brake channels are also generally diametrically opposed to each other, and are generally similar in cross-section to the drive channels, but they are oppositely curved and the flat bottom has a slightly greater width. In addition, the radially inner portions of the brake channels are smaller in cross-section than the radially inner portions of the drive channels. This means that the drive channels carry larger volumes of the stream at smaller nozzle sizes. For larger nozzles, the drive and brake channels have comparable flows. This arrangement helps counteract the tendency of the plates to rotate faster with larger nozzles.

In the preferred arrangement, these two groups of special function channels are substantially diametrically opposed, and as briefly noted above, are separated from each other in both directions by a fill channel, each fill channel occupying a space on the disk approximately equal to one of the two groups of three channels described above. Depending on nozzle size, the fill channels may or may not exhibit drive or brake forces, but these channels are designed primarily to ensure that the sprinkling pattern is filled in between the sprinkler and the maximum radius of throw.

In another embodiment, an alternating arrangement of relatively thin range and drive channels extend about the entire plate, with water exit angles of the range channels being less than the water exit angles of the drive channels. In this embodiment, there are twelve of each type of channel, all of which are slightly offset from the plate center. The shape of the plate is different from the first described embodiment in that the center of the plate is generally conical, such that the channels have a greater vertical direction component, transitioning to horizontal closer to the outermost tip of the plate. This example does not require brake channels for acceptably consistent rotation speeds.

Accordingly, in one aspect, the invention relates to a rotor plate for a sprinkler comprising a water impingement surface bounded by an annular peripheral wall and having a radial center, and adapted to be impinged upon by a stream emitted from a nozzle, the water impingement surface formed to include at least one radially extending drive channel having an entrance proximate the radial center and an exit in the peripheral wall, at least one drive channel curving from entrance to exit in a first direction so as to cause the plate to rotate when the stream exits the plate at an offset from the center of rotation; at least one range channel extending substantially radially with little or no curving, from entrance to exit; and at least one brake channel curving from entrance to exit in a second direction opposite the first direction to thereby resist rotation of the plate caused by at least one drive channel.

In another aspect, the invention relates to a rotor plate adapted to be supported on a shaft in axial alignment with a nozzle in a sprinkler head, the rotator plate comprising an annular member having water distribution channels formed on a surface thereof, the channels formed and arranged to radially distribute a stream emitted from the nozzle, alternating ones of the channels curved along their radial lengths to establish first water exit angles and corresponding offsets relative to a radial center line, such that water flowing through the alternating channels will cause the plate to rotate; remaining channels between the alternating channels curved along their radial lengths to establish second water exit angles and corresponding offsets less than the first water exit angles.

In still another aspect, the invention relates to a rotor plate for a sprinkler comprising an annular member having a water distribution surface formed with a plurality of substantially radial channels, formed with a first plurality of the channels having curvatures along their respective radial lengths establishing first water exit angles at exit ends of the channels, and a second plurality of the channels having curvatures along their respective radial lengths establishing second water exit angles at exit ends of the second plurality of channels, the second water exit angles less than the first water exit angles.

DETAILED DESCRIPTION OF THE INVENTION

With reference initially to FIGS. 1, 2, 6 and 7, the water distribution plate 10 in accordance with a first exemplary embodiment is a circular, disk-like component with an outer peripheral edge 12. The operative side of the plate is generally "cone-shaped" at the center, with an apex 14 that, when mounted in a sprinkler assembly, is closest the water discharge orifice of the sprinkler nozzle. From the apex 14 (coinciding with the vertical center axis of the plate 10), the various channels extend outwardly to the peripheral edge 12, with the entrance to each of the drive and brake channels in the apex region being slightly offset from the center axis of the plate (best seen in FIG. 2).

A primary stream from a fixed nozzle (not shown) impinges on the plate in the apex region and is split into several secondary streams that transition from a substantially vertical orientation to a substantially horizontal orientation for radial distribution via the channel exits. In this embodiment, the transition occurs fairly uniformly from the entrances to the exits of the channels.

Figure 4:
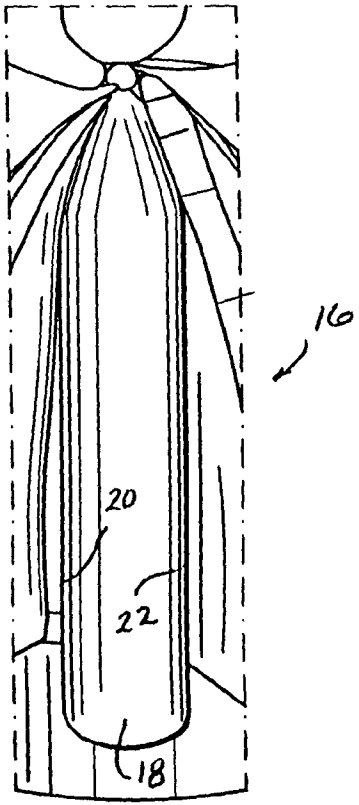
FIG. 4 is a perspective view of a range channel taken from the rotor plate shown in FIGS. 1 and 2.

Four types of discrete channels are provided in the plate, i.e., drive, range, brake and fill channels. With reference also to FIG. 4, a pair of range channels 16 are substantially diametrically opposed, with, as noted above, inner ends or entrance locations that are substantially on center relative to the vertical axis of rotation of the plate. The range channels 16 are substantially V-shaped in cross-section proximate the plate center but quickly transition to a substantially U-shaped profile for substantially their entire radial lengths, with a base 18 and side walls 20, 22. The channels 16 do not curve relative to their radial center lines, and are substantially constant in width except for the radially innermost portion thereof. The water flowing through the range channels will exit mainly from the bottom or base of the channel, in a shallow U-shape, but will achieve a greater throw radius than any of the drive, brake or fill channels.

Figure 2:
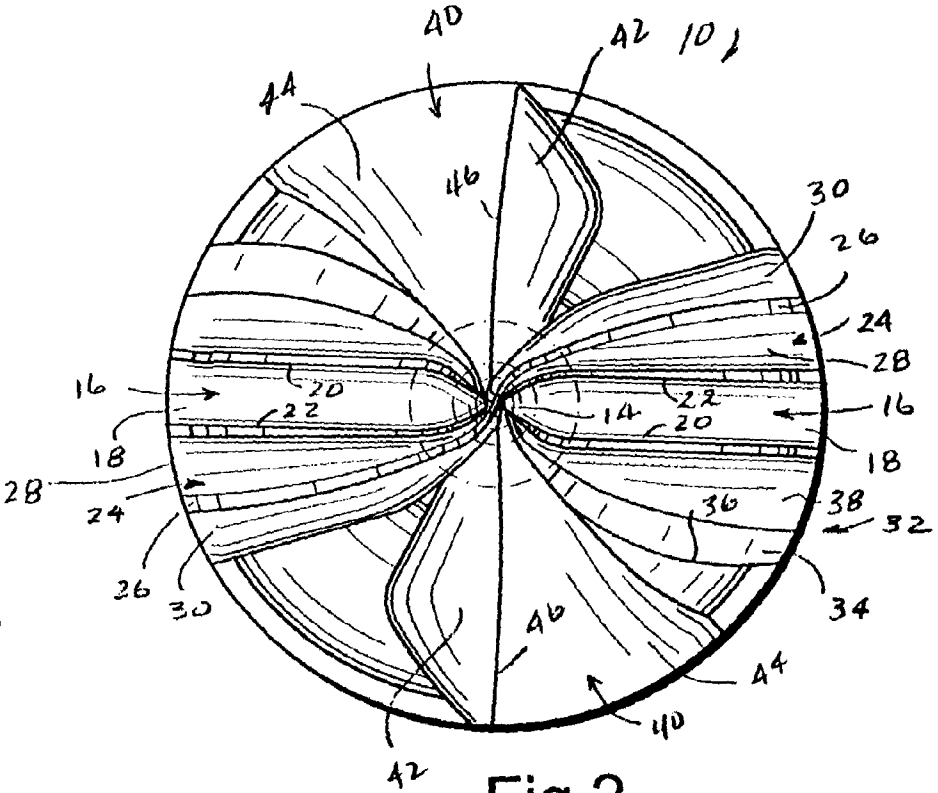
FIG. 2 is a plan view thereof.
Figure 1:
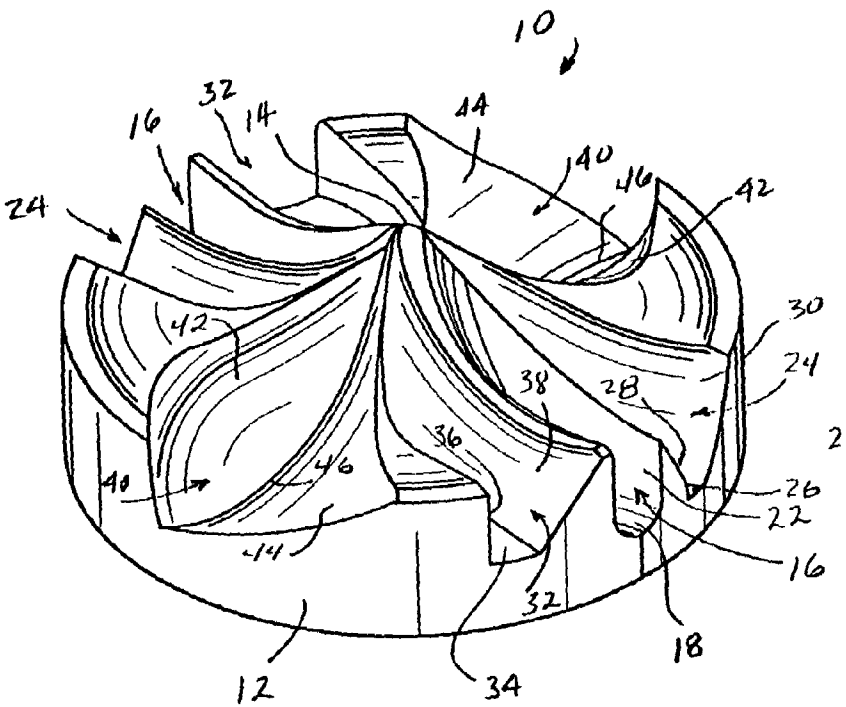
FIG. 1 is a perspective view of a rotor plate in accordance with a first exemplary embodiment of the invention.
Figure 3:
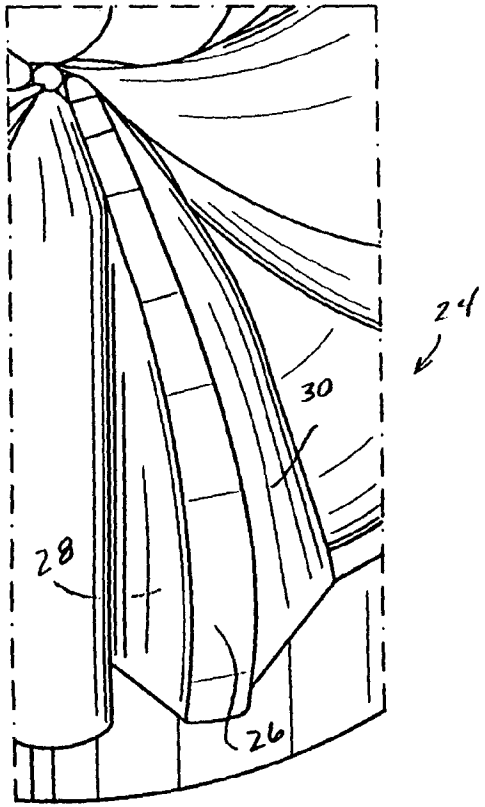
FIG. 3 is an enlarged perspective view of a drive channel taken from the rotor plate shown in FIGS. 1 and 2.
Figure 7:
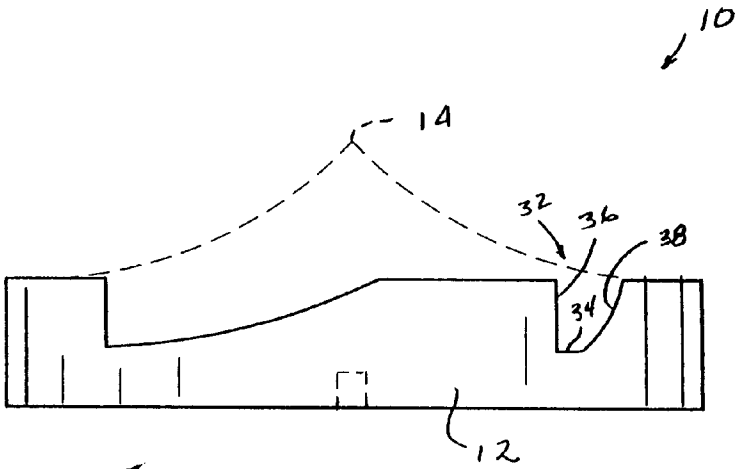
FIG. 7 is a partial side elevation similar to FIG. 6 but rotated in a counterclockwise direction 90°.
Figure 6:
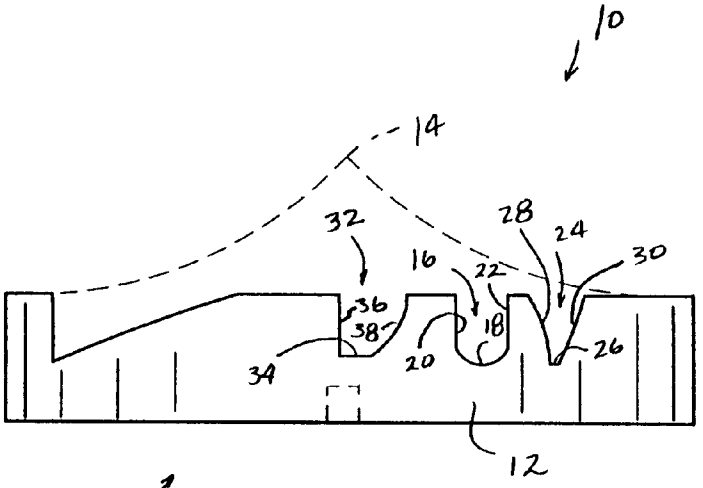
FIG. 6 is a partial side elevation of the rotor plate shown in FIGS. 1 and 2, illustrating the channel profiles at the periphery of the rotor plate.

With reference also to FIG. 3, drive channels 24 lie immediately adjacent the range channels 16, in a counterclockwise direction as viewed in FIGS. 1 and 2. Each drive channel transitions from a substantial V-shape at its radially inner end to a channel with a flat-bottom 26 and steeply sloping sides 28, 30. The center point of each drive channel exit is offset from the axis of rotation by about 0.313 inches, establishing a water exit angle of about 25°, thus causing the water to exert a rotational drive force on the plate.

Figure 5:
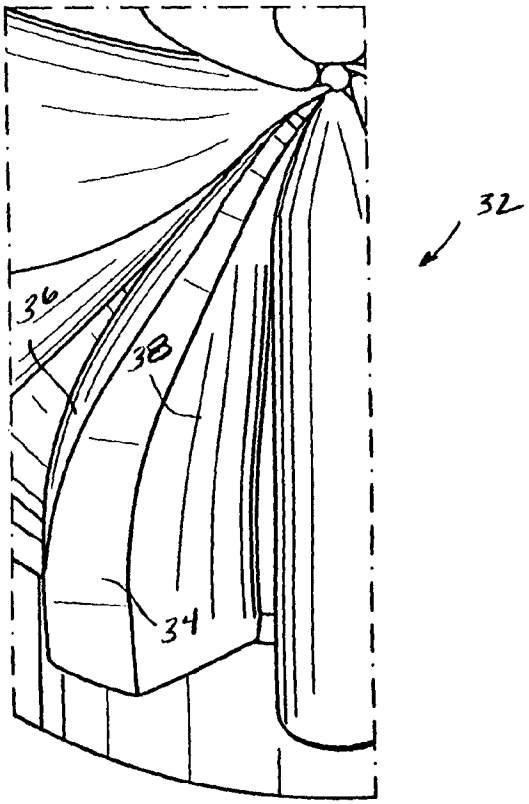
FIG. 5 is a perspective view of a brake channel taken from the rotor plate shown in FIGS. 1 and 2.

With reference also to FIG. 5, brake channels 32 are also located immediately adjacent to the range channels 16, but on the opposite side of the range channels relative to the drive channels. The brake channels are similar to the drive channels but curved in the opposite direction. Thus, each brake channel is also substantially V-shaped at its inner radial end, and transitions to a channel with a wider, flat bottom 34, a substantially vertical side 36, and a sharply curved side 38. The center point of each brake channel exit is offset from the axis of rotation by about 0.387 inch, establishing a water exit angle of about 31°, thus counteracting the rotational drive of the plate, especially with increasing amounts of water flow. Note, however, that the drive channels 24 have a greater width proximate the center axis of rotation, thus handling a greater volume of water than the brake channels, especially for smaller diameter nozzles.

Two remaining channels that are substantially diametrically opposed and circumferentially between each group of range, drive and brake channels. These are the fill channels 40, each about as large as one of the groups of three range, drive and brake channels. Each fill channel has curved side walls 42, 44, sloping upwardly relative to a channel bottom, indicated by reference number 46, that separates the side walls from entrance to exit. These fill channels are designed primarily to distribute water in a mid range, between the sprinkler and the maximum throw radius (generated by the range channels).

As mentioned above, the above plate is designed for use with a variety of standard nozzle sizes, for example, #14 through #50, nozzle #14 having the smallest diameter. For the smaller nozzles (#14-28), the largest proportion of the stream is handled by the range grooves 16. For larger nozzles (29-50) the largest proportion of the stream is handled by the fill channels 40.

With reference now especially to FIG. 2, three different nozzle diameters are superimposed on the plate, illustrating how the proportion of total stream volume in the drive or brake channels varies with nozzle size to minimize speed variation. As indicated above, for smaller nozzles, more water is transferred to the drive channels (where it is most needed) than to the brake wheels.

This combination of groups of drive, range and brake channels separated by fill channels represents an advance over prior rotor plate designs, providing extended range and greater uniformity over a range of nozzle sizes. There may be instances, however, where the brake channels are not required and can thus be omitted.

Figure 10:
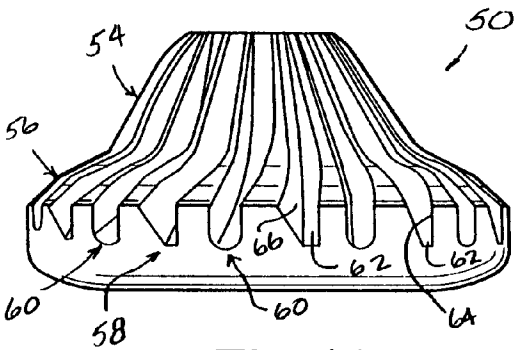
FIG. 10 is a side elevation of FIG. 9.
Figure 9:
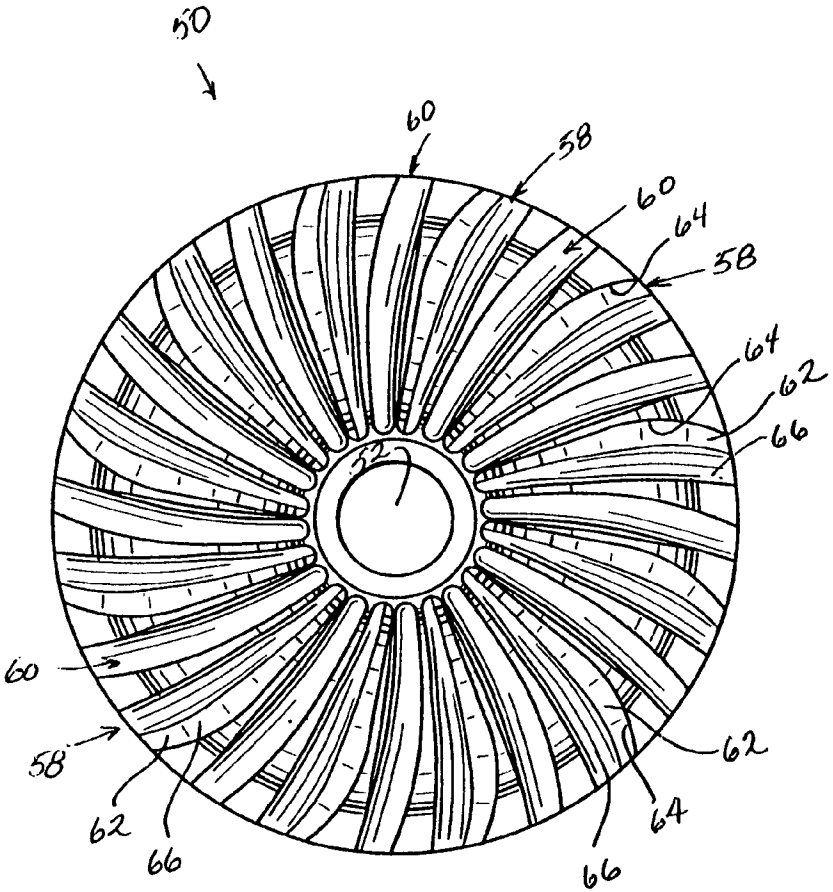
FIG. 9 is a bottom plan view thereof.
Figure 8:
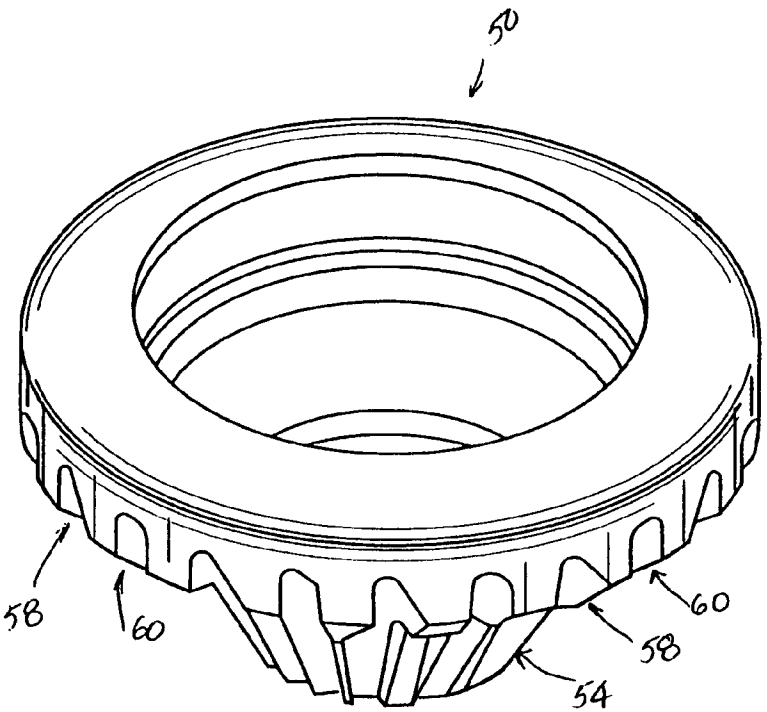
FIG. 8 is a perspective view of a rotor plate in accordance with a second exemplary embodiment of the invention.

Turning to FIGS. 8-10, a second embodiment of the invention includes a generally conical rotor plate 50 that includes a center bore 52 coincident with the axis of rotation, and adapted to receive a sprinkler head shaft. The plate 50 includes a steeply angled base portion 54 where the water distribution channels extend at an acute angle relative to the axis of rotation. In the upper portion 56 of the plate, the grooves or channels extend at a significantly shallower angle to transition the stream to a generally horizontal orientation, so as to redirect the divided primary vertical stream radially outwardly through the channels. In this embodiment, brake and fill channels have been eliminated in favor of drive and range channels 58, 60, respectively, that are alternately arranged about the entire 360° extent of the rotor plate. The drive channels 58 are each formed with a substantially asymmetrical and truncated V-shaped cross-section. The curvature at the outer end that results in a water angle exit of about 30°, relative to a radial center line through the channel. The drive channels are formed to include a flat bottom 62, a substantially vertical side wall 64 and a sloped side wall 66.

The range channels 60 alternate with the drive channels 58, and each has a smaller curvature, resulting in a water exit angle of about 15°. The channels 58, 60 need not alternate, however, and could be arranged in other patterns as desired. Each range channel is substantially U-shaped in cross-section from entrance to exit.

In this embodiment, a relatively small range of flow rates is utilized, making brake channels unnecessary. In addition, the range channels 60 do provide some drive function but only in a secondary capacity vis-a-vis the drive channels 58. In this second embodiment, extended range has been achieved without negatively impacting the driveability of the rotor plate.

The rotor plates as described herein are preferably made of plastic material but other suitable materials may be used.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotor plate adapted to be supported on a shaft in axial alignment with a nozzle in a sprinkler head, the rotor plate comprising an annular member having water distribution channels formed on a surface thereof, said channels formed and arranged to radially distribute a stream emitted from said nozzle, a first group of said channels curved along their radial lengths and establishing first water exit angles relative to a first radial center line, such that water flowing through said first group of channels will cause said plate to rotate; other of said channels curved along their radial lengths and establishing second water exit angles relative to a second radial center line, less than said first water exit angles.

2. The rotor plate of claim 1 wherein said first water exit angles are about 30°.

3. The rotor plate of claim 2 wherein said second water exit angles are about 15°.

4. The rotor plate of claim 1 wherein said second water exit angles are about 15°.

5. The rotor plate of claim 1 wherein said other of said channels are substantially U-shaped in cross-section.

6. The rotor plate of claim 1 wherein said first group of said channels are flat-bottomed.

7. A rotor plate for a sprinkler that emits a stream from a nozzle comprising an annular member having a water distribution surface formed with a plurality of substantially radial channels, a first plurality of said channels having curvatures along their respective radial lengths establishing first water exit angles relative to a first radial center line, at exit ends of said channels, and a second plurality of said channels having curvatures along their respective radial lengths establishing second water exit angles relative to a second radial center line, at exit ends of said second plurality of channels, said second water exit angles less than said first water exit angles.

8. The rotor plate of claim 7 wherein radially inner ends of said first plurality of channels are larger than radially inner ends of said second plurality of channels thereby ensuring a greater volume water in said first plurality of channels for small nozzle sizes.

9. A rotor plate adapted to be supported on a shaft in axial alignment with a nozzle in a sprinkler head, the rotor plate having a plurality of water distribution channels formed on a surface thereof, said channels formed and arranged to radially distribute a stream emitted from said nozzle, a first group of said plurality of channels substantially V-shaped in cross-section and otherwise configured to establish first water exit angles relative to a first radial center line, such that water flowing through said first group of channels will cause said plate to rotate; and a second group of said plurality of channels substantially U-shaped in cross-section and otherwise configured to establish second water exit angles relative to a second radial center line less than said first water exit angles.

10. The rotor plate of claim 9 wherein said first water exit angles are about 30°.

11. The rotor plate of claim 10 wherein said second water exit angles are about 15°.

12. The rotor plate of claim 9 wherein said second water exit angles are about 15°.

13. A rotor plate for a sprinkler that emits a stream from a nozzle comprising an annular member having a water distribution surface formed with a plurality of substantially radial channels, a first plurality of said radial channels configured to establish first water exit angles relative to a first radial center line at exit ends of said channels, and a second plurality of said channels curved along their respective radial lengths to establish second water exit angles relative to a second radial center line at exit ends of said second plurality of channels, wherein said second water exit angles are less than said first water exit angles.

14. The rotor plate of claim 13 wherein radially inner ends of said first plurality of channels are larger than radially inner ends of said second plurality of channels thereby ensuring a greater volume of water in said first plurality of channels for small nozzle sizes.

15. The rotor plate of claim 13 wherein said first water exit angles are about 30°.

16. The rotor plate of claim 15 wherein said second water exit angles are about 15°.

* * * * *